United States Patent [19]

Danieli

[11] 4,057,099

[45] Nov. 8, 1977

[54] DEVICE FOR OSCILLATING A CONTINUOUS CASTING MOULD

[75] Inventor: Luigi Danieli, Udine, Italy

[73] Assignee: Officine Meccaniche Danieli, Udine, Italy

[21] Appl. No.: 639,692

[22] Filed: Dec. 11, 1975

[30] Foreign Application Priority Data

| | | |
|---|---|---|
| Dec. 11, 1974 | Italy | 83446/74 |
| Dec. 12, 1974 | Italy | 83449/74 |
| Nov. 19, 1975 | Italy | 83476/75 |

[51] Int. Cl.[2] ..... B22D 11/04

[52] U.S. Cl. ..... 164/260

[58] Field of Search ..... 164/260, 71

[56] References Cited

U.S. PATENT DOCUMENTS

| | | | |
|---|---|---|---|
| 3,612,156 | 10/1971 | Schoffmann | 164/260 |
| 3,662,813 | 5/1972 | Stull | 164/260 X |

*Primary Examiner*—Robert D. Baldwin
*Attorney, Agent, or Firm*—A. W. Breiner

[57] ABSTRACT

A device for oscillating ingot moulds in continuous casting plants, the oscillations being in a linear or curvilinear course comprising in reciprocal coordination and cooperation a lever (16) extending laterally to ingot mould (29) and having two arms (18) disposed symmetrically with respect to ingot mould (29);

two vertical uprights (25) positioned laterally to ingot mould (29), and hinged (21) onto arms (18) of lever (16) and both extending upwards to surface (24) supporting the ingot mould and being rigidly fixed to surface (24);

guide surfaces (33) geometrically defined by the course of the ingot mould (29) and secured to the vertical uprights (25);

roller guides (34-35) for each vertical upright (25), anchored to the carrying structure and cooperating with guide surfaces (33), and elastic adjustable traction means (31-32) extending above lever (16) and located laterally to the ingot mould, guide surfaces (33) being anchored near surface (24) supporting the ingot mould and lever (16) being positioned below the upper surface of the ingot mould (29).

The device is easily adapted for any course which the ingot mould is to follow during its oscillations and provides a simple, easily accessible, and sturdy system of levers.

10 Claims, 9 Drawing Figures

16
18
19
17
23
20
18
21
22

34
37
38
39
41
24
36
25
47
48
33
35
28
36
33
31
16
23
20
18
10
21
22
12
14
15
13
19
17
11

DEVICE FOR OSCILLATING A CONTINUOUS CASTING MOULD

The present invention refers to an improved mechanical system designed to provide continuous vibration or oscillation of an ingot mould of the type employed in iron-making plants commonly referred to as continuous casting plants. More specifically, the invention refers to improvements to devices suitable for imparting to a continuous casting ingot mould oscillations or vibrations of a desired value which can be regulated within the entire range from a minimum value to a maximum value.

Mechanical systems are known which generate vibrations and/or oscillations of a desired value in ingot moulds, including those which employ a lever of various kinds to transfer the movement from a motive source to the ingot mould. Other systems have at the sides of the ingot mould some means suitable for imparting to the ingot mould itself movement along the desired course. It is also known that the course which an ingot mould must complete during the oscillation and/or vibration phase has to be correlated in a coordinated manner to the successive course which the ingot, emerging continuously, has to follow.

Prior systems involve numerous difficulties. A first difficulty is the need to use complex lever systems. A second difficulty is the need to use levers which are intricate and function in a manner largely unsuited to the severity of the application. Another difficulty is the fact that a device which is designed for a linear oscillation cannot be transformed into one for a curvilinear oscillation and vice versa. Still a furher difficulty is the employment of one single guide system applied to the two opposite ends of the ingot mould, and this is a fact which involves very close working precision in setting up and assembly, these being requirements ill-fitted to this type of application. Yet another difficulty is the system for mounting the guide means, which involves concentrated overloads on the means themselves and causes easy and rapid breakage thereof.

The improvements which are the subject of the present invention have been planned so as to avoid all the aforesaid difficulties. Besides tending to create a device which can be easily adopted for any course which the ingot mould may have to follow during its oscillation, the improvements also tend to bring about numerous advantages, including realization of a simple, easily accessible and sturdy or solid system of levers; creation of a double independent guide for each side of the ingot mould; realization for each double guide a guide system in both a lateral and a transverse direction; and a system wherein each double guide is realized with only one group of guiding roller-means, and this is a fact which simplifies construction, assembly, and adjustment. These and other purposes and advantages will become clear hereafter in the description, wherein the improvements are illustrated in some of their applications, which are detailed for non-limitative, exemplificative purposes.

The invention is illustrated by means of a device or devices for oscillating the ingot moulds in continuous casting plants, wherein the oscillations are linear or are carried out along a desired curvilinear course, the improvements being characterized by the fact that they present in reciprocal coordination and cooperation a lever, extending laterally to the ingot mould, with two arms disposed symmetrically in respect of the ingot mould itself;

two vertical uprights, which are positioned laterally to the ingot mould, are hinged to the arms of the lever and both extend upwards to the surface supporting the ingot mould and being rigidly fixed to said surface;

sliding guide blocks, which are geometrically defined by the course of the ingot mould and are fixed to said vertical uprights;

roller guides anchored to the carrying structure and cooperating with said sliding guide blocks; and elastic adjustable traction means extending above said lever and positioned laterally to the ingot mould, wherein said sliding guide blocks are anchored near to the surface supporting the ingot mould and the lever is positioned lower than the upper surface of the ingot mould.

Where the course of the ingot mould is linear, the lever has its fulcrum and the points of application of the motive force and of the resisting force substantially on the same plane and, in its central position, substantially with said plane passing along a line perpendicular to the axis of the ingot mould, while the sliding guide blocks have a geometric generating line substantially parallel to the axis of the ingot mould.

Where, on the other hand, the course of the ingot mould is curvilinear, the lever has its point of application of the resisting force displaced in respect of the plane passing through the fulcrum and through the point of application of the motive force, said plane being perferentially perpendicular to the axis of the ingot mould in its central position while the upper surface supporting the ingot mould is near the horizontal line passing through the center of formation of the curvature arcs of the geometric generating line constituting the sliding guide blocks.

In the attached drawings, which are given for non-limitative, exemplificative purposes, FIG. 1 illustrates a device for linear oscillation of the ingot mould;

FIG. 2 illustrates a device for curvilinear oscillation of the ingot mould;

FIG. 3 gives a perspective view of the lever which transmits motion from the motor means to the resisting means;

FIG. 4 gives a front view of the device of FIG. 2;

FIG. 5 shows a variant of the application of the motor means; and

In the figures the same parts or parts performing the same functions have like reference numbers.

Figure 1:
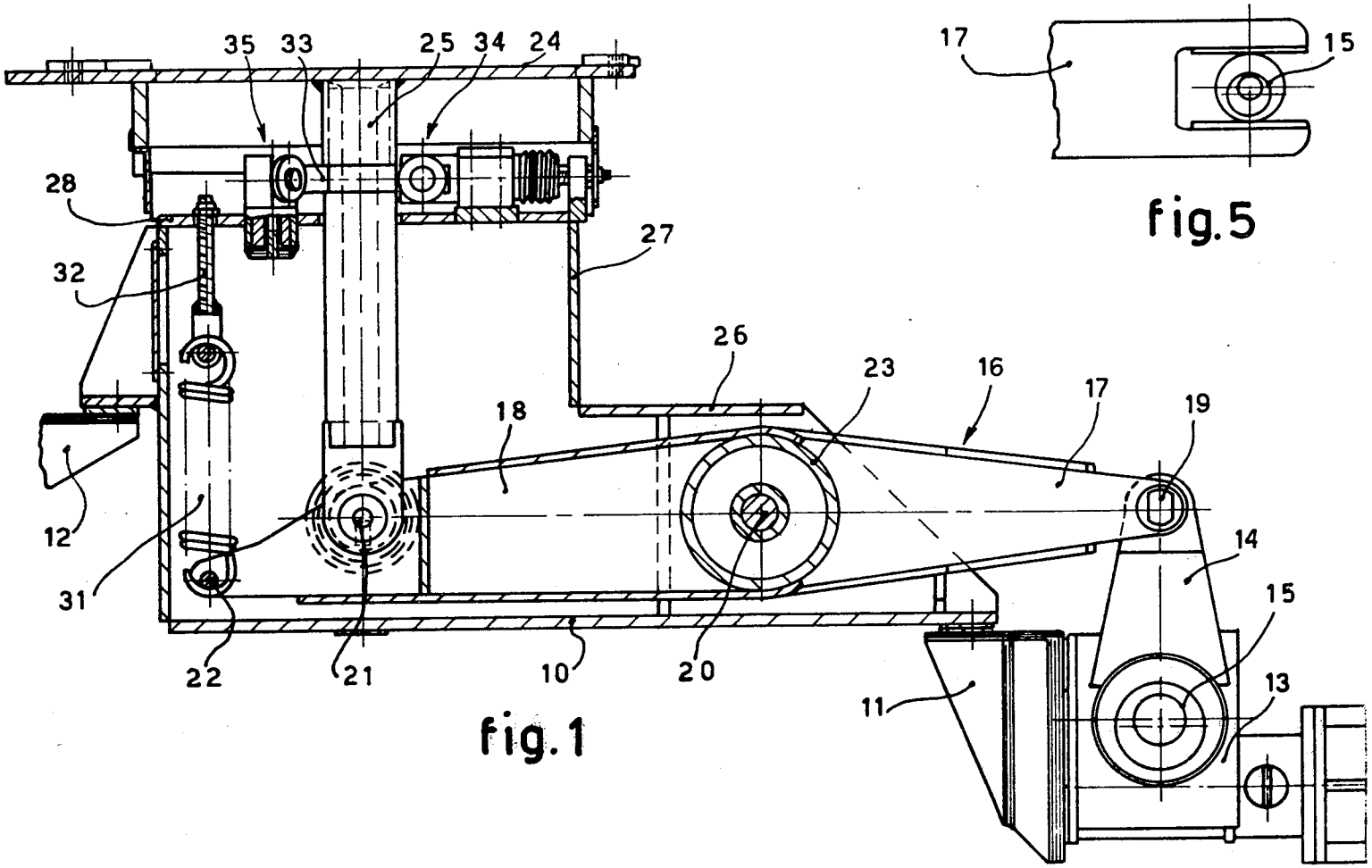

In the figures, 10 refers generally to the carrying structure of the device and consists of a front body 26 and of two wings 27 which are disposed laterally to the ingot mould. Frame 10 is supported by the general structure, referenced 12 at its rear and 11 at its front. On structure 11 or on a suitable adjunct present on frame 10, drive means 13 is positioned. 14 is the connecting rod, while 15 is the adjustable eccentric of a known type which transmits movement from drive means 13 to the connecting rod 14. 16 is the transmission lever and has a central body 23, onto which is keyed the fulcrum 20, from which there extends a lever 17, connected to the connecting rod 14, and two levers 18 which run beside the ingot mould and within the wings 27. 19 is the rotatable pivot for application of the connecting rod 14 to the lever 16. 21 is the pivot, one for each lever 18, to which is connected in an oscillating manner the column or upright 25, which in turn is connected rigidly to the surface 24 supporting the ingot mould 29. 22 is the pivot, one for each lever 18, to which is connected the traction spring 31, whose tension can be adjusted by means of the tension bar 32, which is secured to the surface 28 present above each wing 27. 30 are fixture means for ingot mould 29 to its supporting surface 24. 33 are the sliding guide blocks and are solidly anchored, close to the surface 28, to the uprights 25. 34 are generally the front roller guides, which cooperate with the guide surfaces 33. 35 are generally the rear roller guides, which cooperate with the guide surfaces 33. 36 are the guide rollers. 37 are the elastic reaction means and consist of springs, compression springs, volute springs, etc. 38 are the means for regulating the preloading of the reaction means 37. 39 is the movable group bearing the guide rollers 36 of the front guides 34. 40 is the immovable group bearing the guide rollers 36 of the rear guides 35. 41 is the pivot on which the movable group 39 hinges when it is arranged for curvilinear oscillation of the ingot mould. 42 are the guides for the group 39 when it is arranged for linear oscillation of the ingot mould. 43 is the sliding surface, having the required geometric conformation and being present in the guide surfaces 33, said sliding surface is preferentially positioned at the rear and serves as a main transverse guide. 44 is the sliding surface positioned substantially at right angles to the surface 43 and serves as a lateral guide. 45, which also has the desired geometric conformation, is the sliding surface present in the guide surfaces 33 and is located in a position diametrically opposite to the sliding surface 43. Surface 45 also serves as a transverse guide but with secondary functions. 46 is the sliding surface to replace the surfaces 43 and 44. 47 is the generating line which is used in case of curvilinear oscillation and passes through the origin 48 of the center of the ingot mould and coincides with the sliding surface 44. When lever 16 is in the central position of oscillation, said generating line passes through the rotatable center of attachment of the upright 25 to the lever 16 itself.

The method of functioning or operation is as follows:

After the extent of oscillation required has been set on the eccentric 15 and the drive means 13 has been set in motion, the oscillation is transmitted to the lever 16 either through the connecting rod 14 or by the system shown in FIG. 5, wherein the eccentric cooperates with two lips present in the end part of the arm 17. The drive means in the drawing consists of a geared motor, but could be replaced with any other known type. The lever 16 oscillates at 20 and transmits the motion with its arms 18 to the uprights 25. It is also urged to remain always thrust upwards by the spring 31, whose tractive force can be adjusted as desired. Uprights 25, being solidly fixed to the surface 24, transmits the movement through said surface 24 to the ingot mould 29, which is supported by the surface 24 itself. The movement applied to the ingot mould is characterized both by the shape of the lever 16 and by the configuration of the sliding guide blocks 33.

In a case where the ingot mould is to oscillate in a linear manner, this being the case assumed in the example of FIG. 1, the lever 16 is arranged with the pivots 19-20-21 all positioned on the same plane and, in its central position of oscillation, said plane is substantially at right angles to the vertical axis of the ingot mould. Again, in the case assumed in FIG. 1, the guide surfaces 33 have the sliding surfaces 43-44-45 or 46 parallel to the vertical axis of the ingot mould. In this case the reaction rollers 36 of the group 34 are able to move in a linear manner and in a direction substantially at right angles to the sliding surface with a view to creating an elastic pressure suitable for taking up any anomalies.

Figure 7:
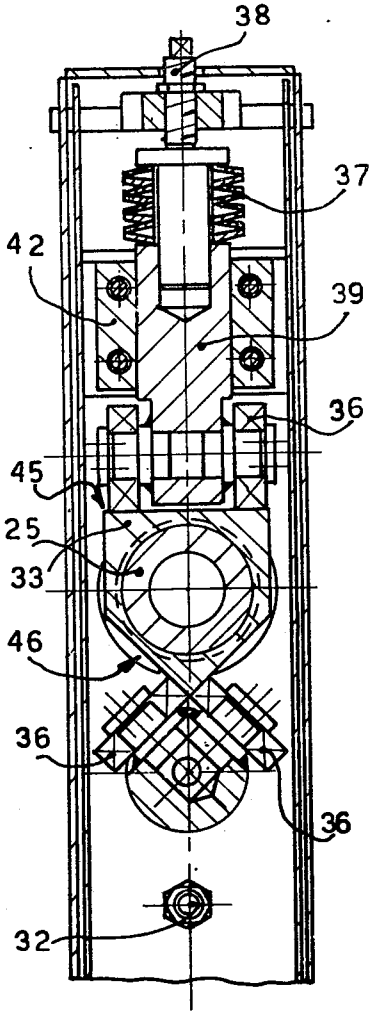
Figure 8:
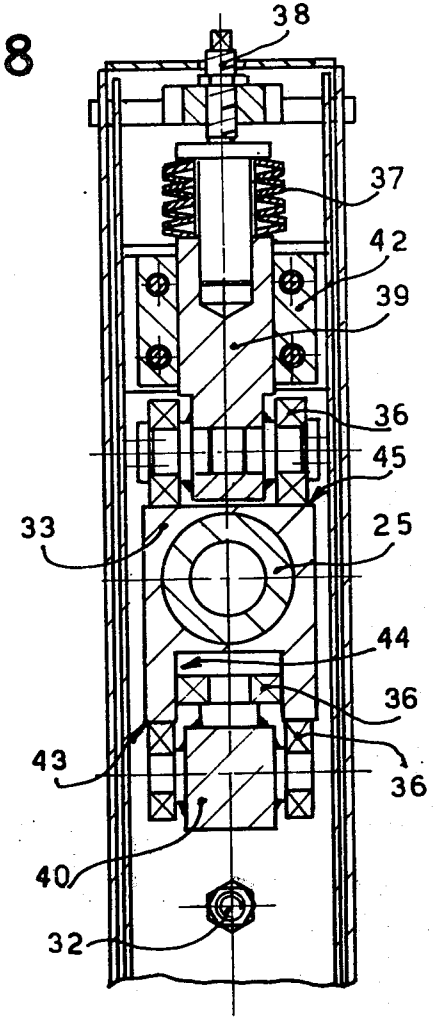

The sliding surfaces may be of the type shown in FIG. 7 or of the type shown in FIG. 8. In FIG. 7 is shown the type with two surfaces 46, one of them at an angle to the other and both of them positioned symmetrically at an angle to the longitudinal plane passing through the center of the upright 25, the purpose thereof being to provide a valid guide both laterally and transversely. In FIG. 8, on the other hand, an improved type is provided for wherein the transverse guide is obtained with the surfaces 45 and 43 while the lateral guide is obtained with the surfaces 44. A roller 36 cooperates with the opposed surfaces 44 and has a diameter slightly smaller than the distance between said two surfaces 44. There is, therefore, both a transverse and a lateral accurate guide, which is efficient and long lasting and reliable and which, as experiments have shown, does not strain the rollers 36 as in the case of FIG. 7 and, thus, does not generate in the rollers 36 the number of breakages which take place in the other case.

Figures 2, 3:
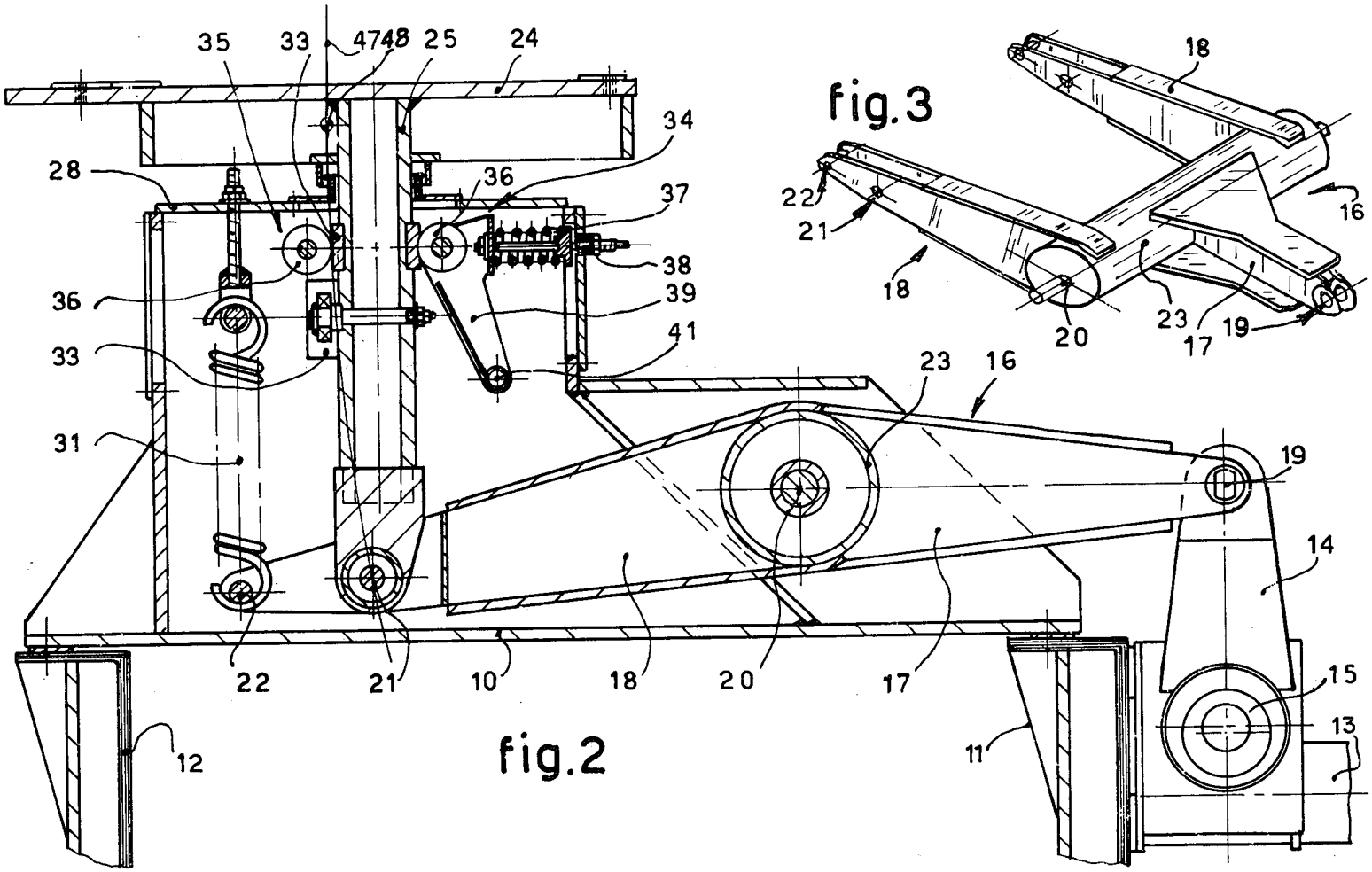
Figure 6:
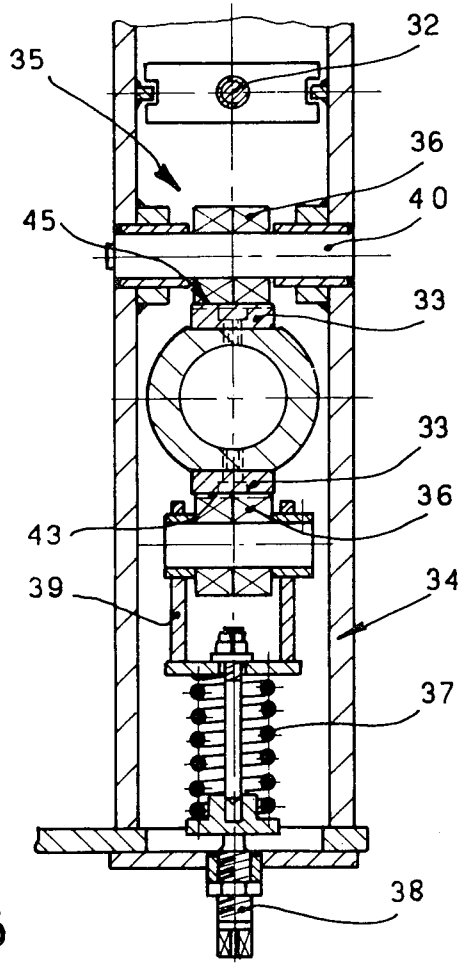
FIGS. 6 to 9 show diverse guide designs in accordance with a substantially horizontal section passing through the sliding guide blocks.
Figure 4:
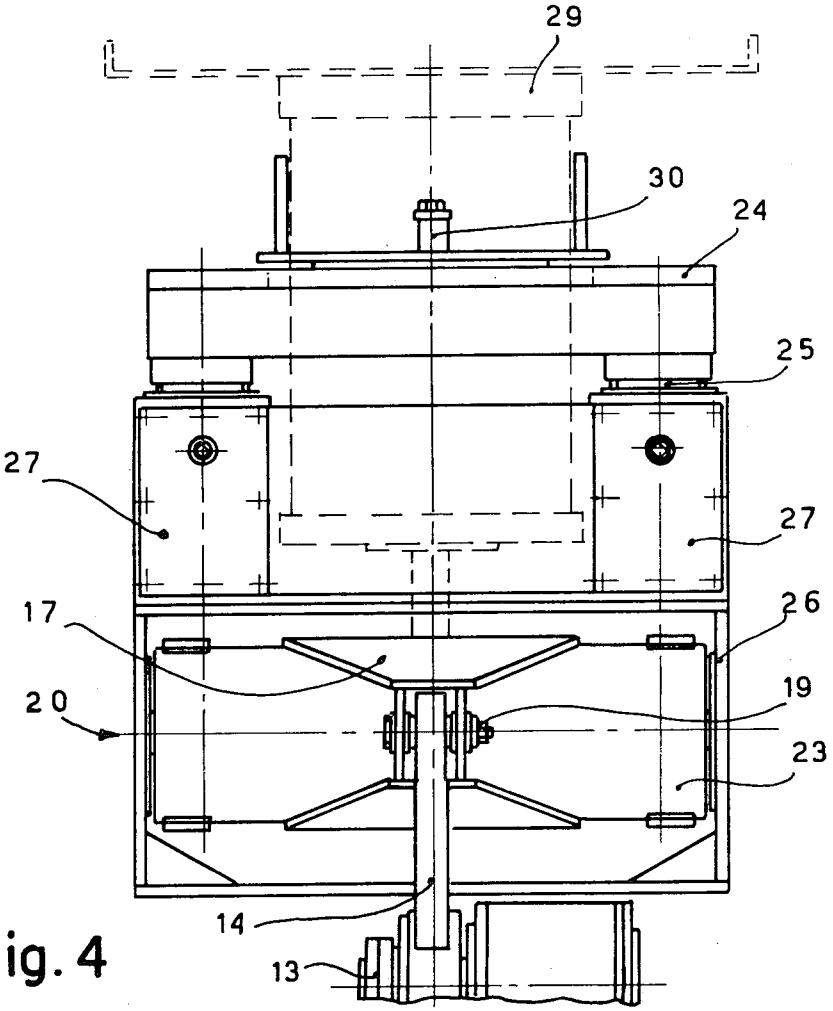
Figure 9:
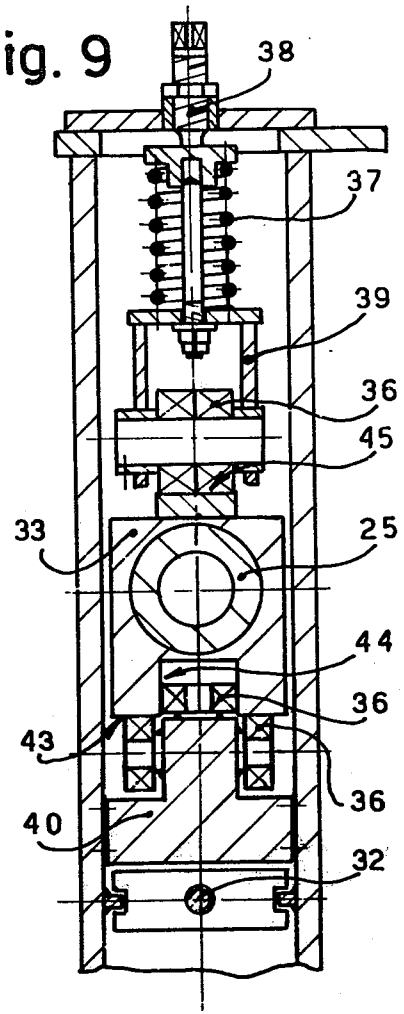

In the event curvilinear oscillation is required, as in the case assumed in FIG. 2, we have the following variations from the case shown in FIG. 1. Lever 16 does not have pivot 21 lying on the plane which passes through the pivots 20 and 19. The pivot 21 may be positioned higher or lower, depending on the space available and, therefore, on the basic data of the practical design. In the normal position, where the lever 16 is at the center line of its oscillation, the pivots 20 and 19 are preferentially located on a plane at right angles to the vertical line touching the arc of curvature 47 at the point of origin 48. The arc of curvature 47, which has its origin in the center line 48 of the ingot mould, preferentially constitutes the geometric generatrix component of the sliding surfaces 43 and passes through the center of the pivot 21 when the lever 16 is located in the central position mentioned above. The transverse guide is, therefore, provided by the surfaces 43 and 45, while the lateral guide is provided by the surfaces 44, whereby this solution affords the advantages indicated in the example of FIG. 8. In the case of a curvilinear oscillation, the surfaces 44 may be staggered in respect of the surfaces 43–45, as in the case of FIGS. 2 and 6, or they may all lie at the same height, as in the case of FIG. 9. The solution of FIGS. 2 and 6, wherein the surfaces 43 and 45 are staggered in respect of surfaces 44, may be adopted also in the case assumed in FIG. 1, where the solution of FIG. 8 has been adopted.

In the case of curvilinear oscillation, the contrast roller is mounted in an oscillating manner (FIGS. 2-6-9) with a view to avoiding unnecessary stresses which, contra-wise to the case where there is linear motion, may operate in different directions. In this manner the contrast roller 36 of the front group 34 has only the task of ensuring the constant pressure of the sliding surfaces 43 against the fixed guide rollers 36. This task is carried out in the case of both linear oscillation and curvilinear oscillation.

We have described some preferential designs. However, variants are possible. It is possible to vary the proportions and sizes; it is possible to realize other design solutions capable of practical realization; it is possible to vary the motor systems, the anchorage systems, the elastic reaction systems, etc.; these and other variants are possible based on the present teaching without departing from the scope of the concept of the disclosed invention.

I claim:

1. In a device for oscillating ingot moulds in continuous casting plants, the oscillations being in a linear or a curvilinear course, the improvement comprising in reciprocal coordination and cooperation lever means mounted on a fulcrum and extending laterally to an ingot mould and attached to a pair of arms disposed symmetrically with respect to said ingot mould, a pair of vertical uprights positioned laterally to said ingot mould and hinged onto said arms of said lever and both extending upwards to a surface supporting said ingot mould and being rigidly fixed to said surface, guide surfaces geometrically defined by the course of said ingot mould and secured to said vertical uprights, roller guides for each vertical upright anchored to a carrying structure and cooperating with said guide surfaces, and elastic adjustable traction means extending above said lever attached to said lever and to a fixed support and located laterally to the ingot mould to urge an upward thrust to said lever;

said guide surfaces being anchored in close proximity to said support surface supporting the ingot mould and said lever means is positioned below the upper surface of the ingot mould.

2. The device of claim 1 wherein said lever means has at least its fulcrum and its center of application of motive force lying on the same plane.

3. The device of claim 1 wherein said guide surfaces have sliding surfaces for transverse guiding and sliding surfaces for lateral guiding and wherein there is a pair of guide surfaces for each lateral side of said ingot mould and each pair of guide surfaces is solidly anchored to said lateral uprights in a position close to the surface supporting the ingot mould.

4. The device of claim 1 wherein said guide surfaces have at least one sliding surface substantially parallel to the fulcrum of said lever and said surface is positioned at the front.

5. The device of claim 1 wherein said guide surfaces have a first sliding surface substantially parallel to a second sliding surface and diametrically opposite thereto with respect to said upright, wherein said first sliding surface cooperates with a third sliding surface positioned substantially at right angles to said first surface, said first sliding surface being positioned at the rear.

6. The device of claim 1 wherein in said roller guides at least one is immovable and at least one is movable and adjustable and applies elastic restraint, wherein said guides, one being opposite the other, cooperate with said guide surfaces and are positioned substantially on the transverse vertical plane passing through said uprights.

7. The device of claim 1 wherein the center of application of the resisting force lies substantially on the plane passing through the other centers, wherein when said lever is in its central position of oscillation said plane is substantially at right angles to the vertical axis of said ingot mould.

8. The device of claim 1 wherein said guide surfaces have sliding surfaces substantially parallel to the vertical axis of the ingot mould.

9. The device of claim 1 wherein the center of application of the resisting force lies out of alignment in respect of the plane passing through the other centers of said lever and wherein when said lever is in its central position of oscillation said plane is substantially at right angles to the tangent of the generating line at its point of formation.

10. The device of claim 1 wherein said oscillation is curvilinear and when said lever is in its central position of oscillation the generating line constitutes the rear sliding surfaces and passes through the center of application of the resisting force.

* * * * *